United States Patent [19]

Nelson et al.

[11] 4,065,857

[45] Jan. 3, 1978

[54] DEHYDRATOR AND METHOD FOR DEHYDRATING FOODSTUFFS

[75] Inventors: Lawrence B. Nelson; Stuart A. Mott, both of Napa; Ray T. Flugger, Petaluma, all of Calif.

[73] Assignee: Sunfresh Products, Napa, Calif.

[21] Appl. No.: 624,967

[22] Filed: Oct. 22, 1975

[51] Int. Cl.[2] ..... F26B 3/04

[52] U.S. Cl. ..... 34/30; 34/48; 34/197; 99/468; 99/476; 99/483; 426/520

[58] Field of Search ..... 34/30, 48, 232, 192–198; 99/476, 468, 483, 447, 448; 126/21 A, 190, 198; 219/400; 426/520, 523

[56] References Cited

U.S. PATENT DOCUMENTS

| | | | |
|---|---|---|---|
| 2,017,728 | 10/1935 | Oskamp | 34/196 |
| 2,380,428 | 7/1945 | Gilliam | 99/476 |
| 2,410,129 | 10/1946 | Phelps | 34/193 |
| 2,414,502 | 1/1947 | Willcox | 34/197 |
| 3,135,589 | 6/1964 | Stokes | 34/197 |
| 3,553,425 | 1/1971 | Fry | 126/190 |
| 3,839,622 | 10/1974 | Mastin | 219/400 |
| 3,943,842 | 3/1976 | Bills et al. | 34/197 |

FOREIGN PATENT DOCUMENTS

| | | | |
|---|---|---|---|
| 48,699 | 1/1940 | Netherlands | 34/232 |
| 31,412 | 10/1904 | Switzerland | 34/195 |
| 284,373 | 1/1928 | United Kingdom | 219/400 |

*Primary Examiner*—John J. Camby
*Assistant Examiner*—Larry I. Schwartz
*Attorney, Agent, or Firm*—Phillips, Moore, Weissenberger, Lempio & Majestic

[57] ABSTRACT

A dehydrator comprises an enclosure having a door pivotally mounted on a front side thereof to normally close a chamber defined in the enclosure. A tubular manifold is disposed in the chamber and defines an inlet passage therein which communicates with the chamber via a plurality of orifices formed in the manifold. The fan is mounted on the enclosure for pumping air into the inlet passage formed in the manifold and a resistance-type heater is disposed in the passage to heat the air to a predetermined temperature level. The heated air is thus discharged through the orifices, formed in the manifold, to dehydrate foodstuffs disposed on racks removably mounted in the chamber of the enclosure. In carrying forth the method of this invention, the heated air is substantially uniformly circulated in the chamber and about foodstuffs disposed therein and such air is discharged from the chamber at a controlled flow rate while simultaneously maintaining a predetermined back pressure on the air in the chamber.

22 Claims, 8 Drawing Figures

FIG. 1.
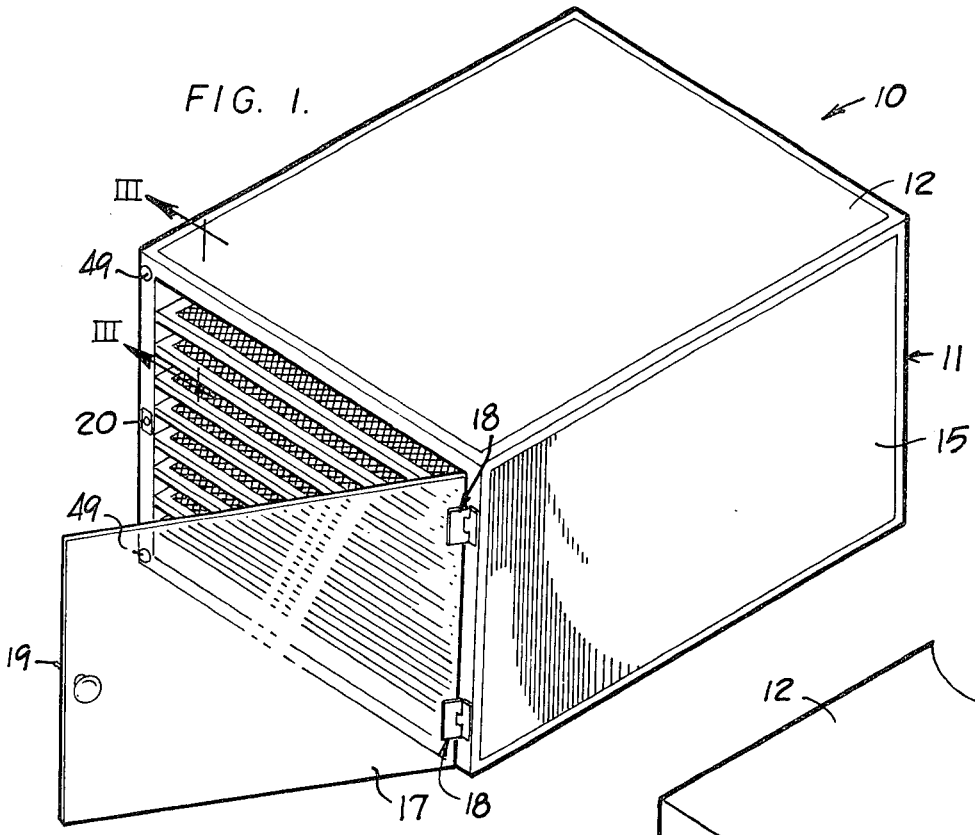
FIG. 3.
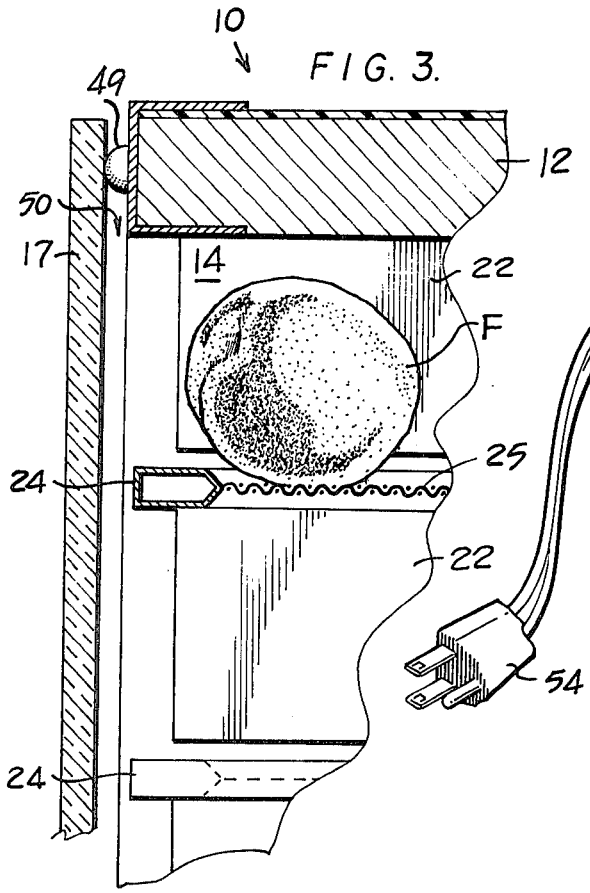
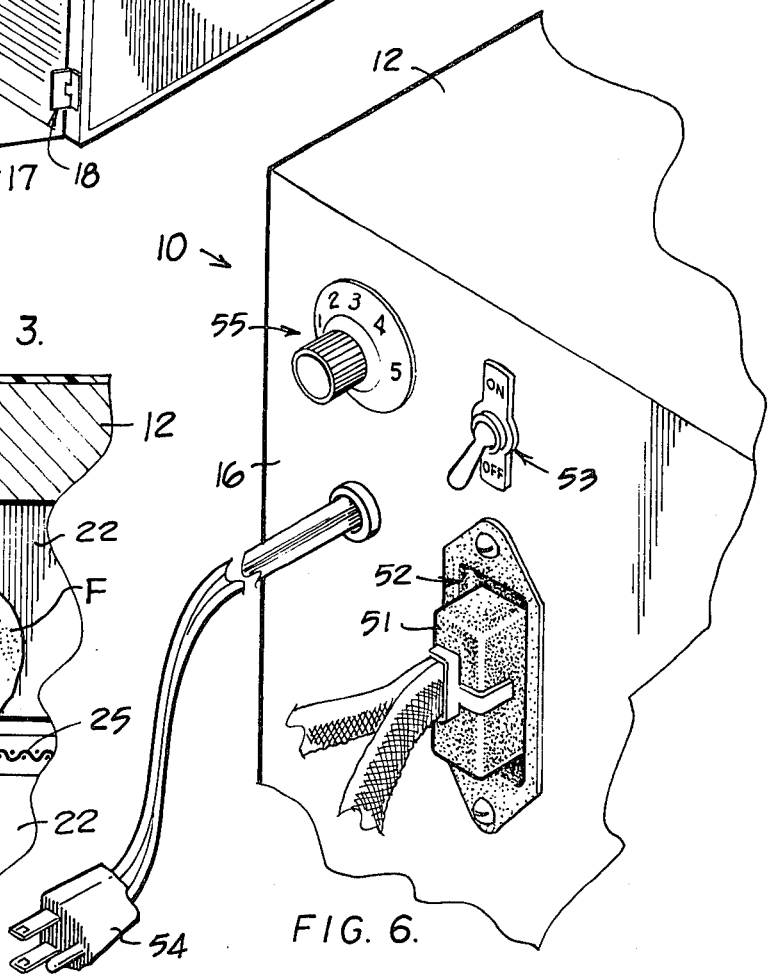
FIG. 6.

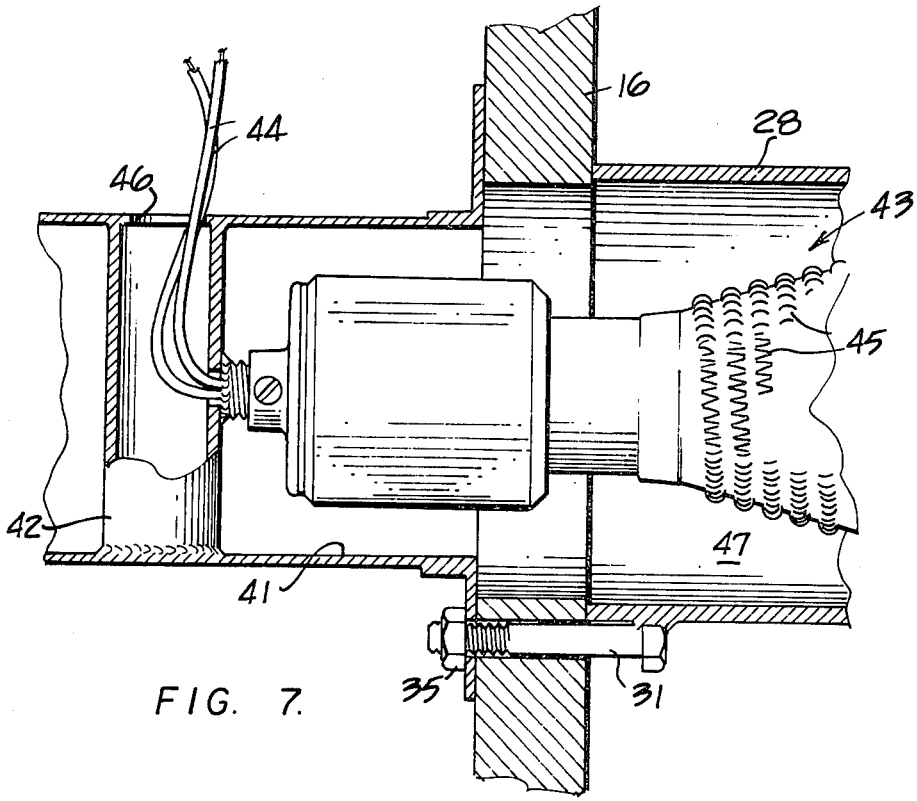
FIG. 7.
FIG. 8.
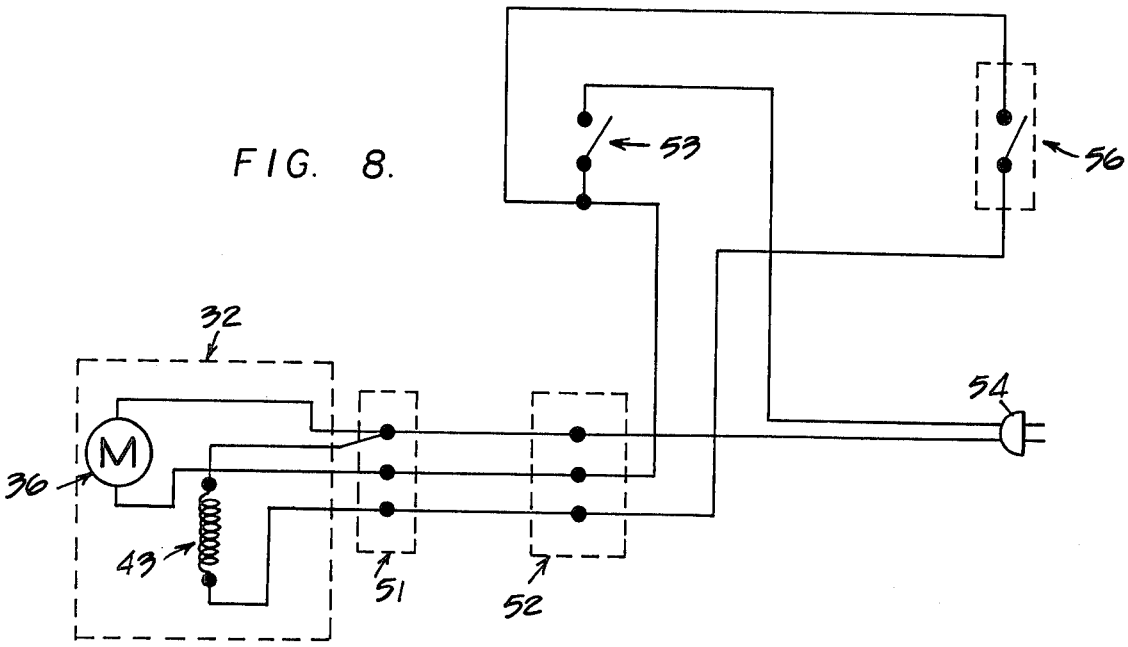

DEHYDRATOR AND METHOD FOR DEHYDRATING FOODSTUFFS

BACKGROUND OF THE INVENTION

Dehydrators have become popular for dehydrating foodstuffs due to their ability to inexpensively and expeditiously dehydrate the foodstuffs for storage purposes. In addition, dehydrators are capable of sealing-in the nutritional qualities and flavors of the foodstuffs and provide an end product which may be stored more readily than foodstuffs processed by other conventional methods, such as freezing and canning. A conventional dehydrator normally comprises an electrical heating unit, such as a Calrod, disposed in an enclosure for heating and dehydrating purposes. In addition to the obvious safety problems, such a dehydrator does provide means cooperating with the heating unit to provide a uniform distribution of heated air about the foodstuffs to assure efficient dehydration thereof.

SUMMARY OF THIS INVENTION

An object of this invention is to provide an economical and efficient apparatus and method for dehydrating foodstuffs expeditiously. The dehydrator of this invention comprises an enclosure defining a substantially closed drying chamber therein and a door movably mounted on a front side of the enclosure for normally closing the chamber and openable to deposit foodstuffs therein. A tubular manifold is disposed in the chamber and defines an air inlet passage therein adapted to receive ambient air from a fan. A heater, preferably disposed in such passage, heats the ambient air to a predetermined temperature level for circulation in the chamber via orifice means formed through walls of the manifold.

In carrying forth the method of this invention, foodstuffs are placed in the chamber of the enclosure to subject them to the heated ambient air pumped thereto by the fan. The heated air is circulated in a substantially uniform manner in the chamber and about the foodstuff to dehydrate the same. The air is discharged from the chamber at a controlled flow rate while simultaneously maintaining a predetermined back pressure on the air in the chamber to assure its uniform circulation therein.

BRIEF DESCRIPTION OF THE DRAWINGS

Other objects of this invention will become apparent from the following description and accompanying drawings wherein:

FIG. 1 is an isometric view of a dehydrator embodying this invention;

FIG. 3 is an enlarged sectional view taken in the direction of arrows III—III in FIG. 1, but assuming that the opened door of the dehydrator is in a closed position;

FIG. 6 is an enlarged isometric view disclosing a backside of the dehydrator with electrical controls mounted thereon;

FIG. 7 is an enlarged sectional view, taken in the direction of arrows VII—VII in FIG. 4; and FIG. 8 schematically illustrates an electrical circuit integrating electrical controls for the dehydrator.

DETAILED DESCRIPTION

Figure 2:
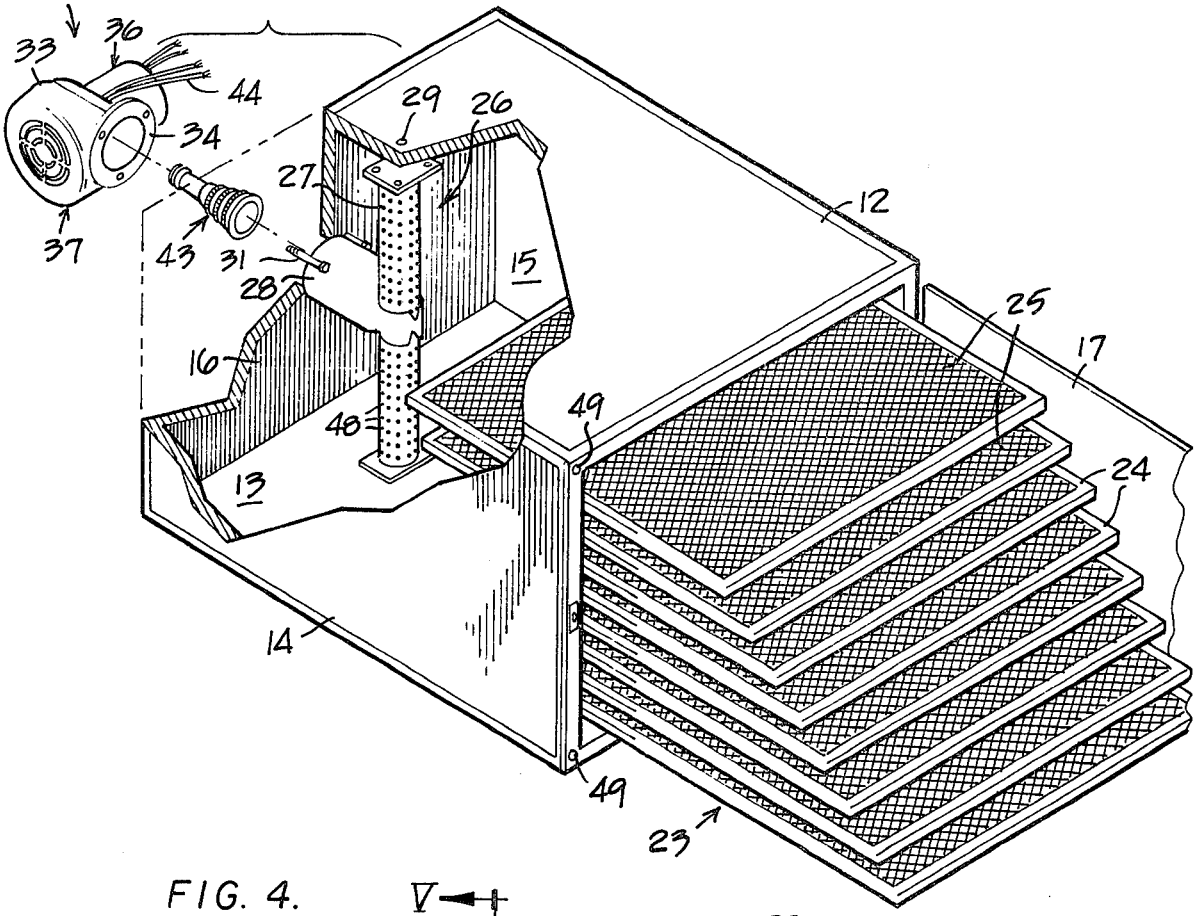
FIG. 2 is a partially sectioned and exploded view of the dehydrator to more clearly illustrate the constructions and arrangements of a perforated manifold, food racks, fan and heater employed therein.

FIGS. 1–5 illustrate a dehydrator 10 comprising an enclosure 11 having a top wall 12, a bottom wall 13, a pair of sidewalls 14 and 15 and a back wall 16. The enclosure defined a substantially closed drying chamber therein adapted to be closed by a door means 17, movably mounted on a front side of the enclosure. Walls 12–16 may be composed of a suitable pressed particle board or plastic material adapted to afford the desirable structural integrity to the enclosure and to withstand heat generated therein, as will be hereinafter more fully described.

Door 17 may comprise a suitably composed transparent plastic material to aid in visually inspecting the interior of the drying chamber defined in the enclosure. The door may be pivotally mounted on a front edge of sidewall 15 by hinge means, preferably comprising a pair of vertically spaced hinges 18. Latch means for normally holding the door in its closed position on the enclosure may comprise a detent 19 secured on the inner side of the door and adapted to be releasably locked within a socket 20 secured on a front edge of panel 14 (FIG. 1).

A plurality of horizontally disposed and vertically spaced support rails 22 (FIGS. 3 and 4) are secured interiorly on side panels 14 and 15 to mount a plurality of rectangular screens 23 thereon. As shown in FIG. 2, each screen may comprise an aluminum frame 24 having a Fiberglas screen 25 secured therein. A Fiberglas or other suitably composed non-metallic material of proper mesh is preferable for the screen to prevent staining of the foodstuffs retained thereon during the dehydration process.

Figure 4:
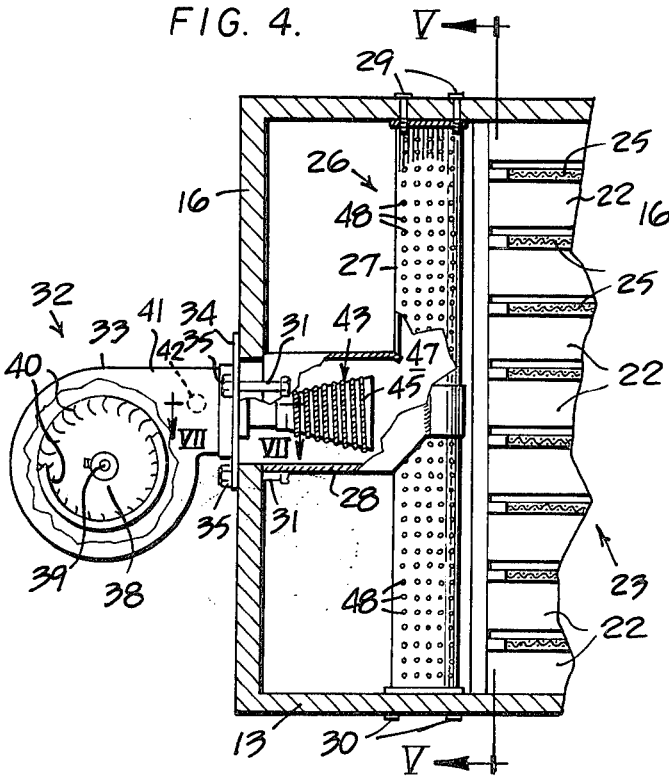
FIG. 4 is an enlarged and partially sectioned view of the dehydrator showing the assembled relationship of the manifold, food racks, fan and heater in side elevation.
Figure 5:
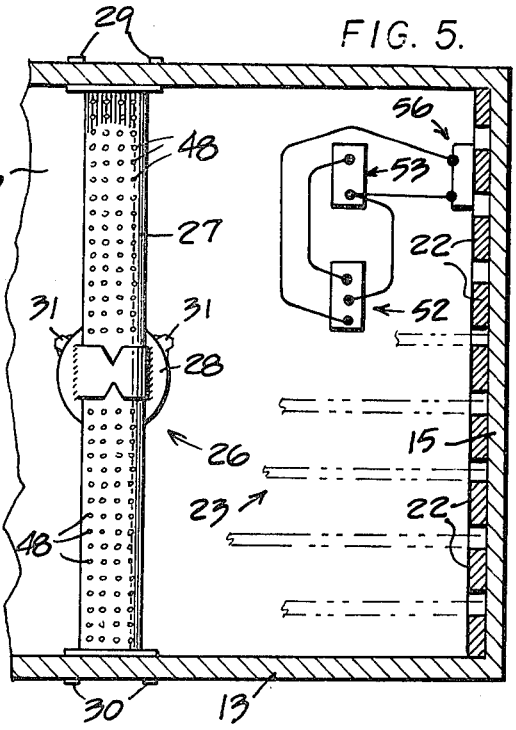
FIG. 5 is a partial sectional view of the dehydrator, taken in the direction of arrows V—V in FIG. 4.

Referring more particularly to FIGS. 2, 4 and 5, a tubular manifold means 26 is preferably disposed at a rearward end of the enclosure and comprises a vertically disposed and perforated outlet conduit 27 and a horizontally disposed inlet conduit 28. The upper end of the outlet conduit may be secured to top wall 12 of the enclosure by bolts 29 whereas the lower end thereof may be secured to bottom wall 13 by bolts 30. The inner end of inlet conduit 28 is welded or otherwise suitably secured to outlet conduit 27 whereas the rearward end thereof has three bolts 31 welded thereto and extending rearwardly through backwall 16 of the enclosure (FIGS. 4, 5 and 7). It should be understood that manifold means 26 could be otherwise disposed in the drying chamber, e.g., conduit 27 could be horizontally disposed and secured between sidewalls 14 and 15.

A combined motor and fan unit or fan means 32 comprises a housing 33 having a flange 34 thereof secured on bolts 31 by nuts 35 (FIG. 7). The unit comprises a standard fractional power electrical motor 36 and a fan or blower 37, having a rotor 38 thereof secured to an output shaft 39 of the motor (FIG. 4). The fan is of the squirrel cage type wherein rotor 38 is cylindrical and comprises a plurality of radically disposed fan blades 40 adapted to pump ambient air through an outlet 41 of housing 33. A typical fan means may constitute the Shaded-Pole Blower manufactured by Dayton Electric Manufacturing Co. as Model No. 2C781.

Referring to FIG. 7, a tubular support 42 is secured within outlet passage 41 of housing 33 and has heating means, preferably in the form of a conventional resistance-type heating unit 43, secured thereto. A pair of shielded electrical wires 44 provide electrical power to filaments 45 of the heating unit and extend through tubular support 42 and an aperture 46 formed through a sidewall of housing 33. The heating unit may be of the type manufactured by Eagle Electric Mfg. Co., Inc. (Cat. No. 415-A) which is rated a 1,000 watts.

It can be seen in FIG. 4 that ambient air pumped into the enclosure by fan means 37 will pass over heating unit 43 to heat the air to a predetermined temperature level. The air is pumped through an inlet passage 47 of manifold 26 to be ejected therefrom by orifice means, preferably in the form of a plurality of calibrated apertures or orifices 48 formed through the walls of conduit 27. It should be further noted in FIGS. 1 and 3 that stop means, preferably in the form of a pair of vertically spaced rubber bumpers 49 secured to the front edge of side panel 14, provide an opening 50 of predetermined depth between door 17 and the peripheral edges of enclosure 11 for purposes hereinafter explained.

Referring to FIGS. 5, 6 and 8, a plug 51 electrically connected to fan means 32 and heating unit 43 is normally inserted into a receptacle 52 mounted on back wall 16 of the enclosure. Activation of the dehydrator is controlled by a master on-off switch 53 subsequent to insertion of a standard plug 54 into a 110 socket. The thermostat control 55 is adapted to selectively regulate the setting of a temperature sensitive switch 56 mounted in the drying chamber (FIG. 5) to thus, in turn, regulate heating unit 43 to maintain the air temperature in the drying chamber at a predetermined level.

The method of dehydrating foodstuffs by using the above described dehydrator will now be explained. Foodstuffs, F (FIG. 3), which may comprise meats, vegetables, fruit or the like, are placed on screens 25 upon opening of door 17. The foodstuffs are preferably spaced one from another to provide for the uniform circulation of heated air thereabout during the dehydrating process. Upon tripping master switch to its "on" position (FIG. 6), heated ambient air is pumped into the drying chamber defined in enclosure 11 via passages 41 and 47 and orifices 48.

The orifices function to substantially uniformly circulate the heated air into the chamber and about the foodstuffs disposed therein. The heated air then discharges through opening 50 (FIG. 3) at a controlled flow rate. Opening 50 is calibrated along with the discharge capacity of fan means 32 and the sizes and arrangement of orifices 48 to maintain a predetermined back pressure on the air confined in the enclosure. Switch 56 will continuously regulate the activation of heating unit 43 to thus closely control the temperature level of the air in the drying chamber.

We claim:

1. A dehydrator comprising an enclosure having horizontally disposed top and bottom walls and vertically disposed side walls defining a substantially closed drying chamber therein, door means movably mounted on a front side of said enclosure for normally closing said chamber and openable for exposing said chamber for depositing foodstuffs therein, separate tubular manifold means disposed entirely in said chamber and having walls, separate from the walls defining said enclosure, defining an air inlet passage therein, said manifold means comprising a vertically disposed outlet conduit secured within said enclosure and extending between said top and bottom walls and an inlet conduit secured to said outlet conduit, means formed through the walls of said manifold means for communicating air from said inlet passage to said chamber, fan means connected to said inlet conduit for pumping ambient air to said inlet passage, and heating means for heating the ambient air pumped to said inlet passage to a predetermined temperature level.

2. The dehydrator of claim 1 wherein said manifold means is disposed at a rearward end of said enclosure and further comprising means defining an opening on a front side of said enclosure for permitting heated air in said chamber to discharge therefrom at a controlled flow rate while simultaneously maintaining a predetermined back pressure on such air.

3. The dehydrator of claim 2 wherein said last-mentioned means comprises stop means disposed on a forward end of said enclosure and normally engaged between said enclosure and said door means to space said door at a predetermined distance from peripheral edges of said enclosure to define said opening therebetween.

4. The dehydrator of claim 1 wherein said heating means is disposed within said inlet passage.

5. The dehydrator of claim 4 wherein said means formed through the walls of said manifold means comprises a plurality of orifices formed through walls of said outlet conduit.

6. The dehydrator of claim 1 wherein said fan means is secured exteriorly on said enclosure.

7. The dehydrator of claim 6 wherein said fan means comprises an electrical motor having an output shaft and a rotor having a plurality of blades secured to said output shaft for rotation therewith.

8. The dehydrator of claim 7 wherein said fan means further comprises a housing having a flange secured to said enclosure.

9. The dehydrator of claim 1 wherein said fan means comprises a housing secured exteriorly on said enclosure and wherein said heating means is secured within said housing and extends into said inlet passage.

10. The dehydrator of claim 9 wherein said heating means comprises an electrical heating unit having a rearward end thereof secured to a support which is, in turn, secured within an outlet passage of said housing.

11. The dehydrator of claim 10 wherein said support is tubular and further comprising shielded wires extending from said heating unit, into said tubular support and through a hole formed through said housing.

12. The dehydrator of claim 1 further comprising a plurality of horizontally disposed and vertically spaced support rails secured interiorly on each of said sidewalls and a plurality of horizontally disposed and vertically spaced screens slidably mounted on said support rails.

13. The dehydrator of claim 12 wherein each of said screens comprises a rectangular frame and a non-metallic screen secured within said frame.

14. The dehydrator of claim 1 further comprising thermostat control means mounted on said enclosure and operatively connected to said heating means, including temperature sensitive switch means mounted in said drying chamber, for regulating said heating means to maintain the temperature of air in said drying chamber at a predetermined level.

15. A method for dehydrating foodstuffs in a drying chamber defined in an enclosure comprising the steps of disposing hydrated foodstuffs in said chamber, receiving unheated ambient air directly from a rearward end of said chamber, pumping heated ambient air in a horizontal direction directly from the rearward end of said chamber towards a forward end thereof by first collecting said air in a collecting chamber and then discharging said air through a plurality of vertically disposed orifices extending between a bottom and a top of said chamber and disposed intermediate sides thereof, substantially uniformly circulating said air in said chamber and about said foodstuffs, and further discharging said air from the forward end of said chamber at a controlled flow rate while simultaneously maintaining a predetermined back pressure on the air in said chamber.

16. The method of claim 15 wherein said disposing step comprises disposing said foostuffs in vertically spaced relationship relative to each other.

17. The method of claim 15 wherein said pumping step comprises pumping said unheated ambient air into said enclosure, heating said air and discharging said air into said chamber via said orifices which are defined in a vertically disposed tubular manifold means disposed at a rearward end of said chamber and between top and bottom walls defining said enclosure.

18. The method of claim 15 wherein said discharging step comprises discharging said air from said chamber through an opening formed at a forward end of said enclosure.

19. The method of claim 18 wherein said discharging step comprises discharging said air from said chamber through an opening defined between peripheral edges of said enclosure and an openable door disposed on a forward end of said enclosure.

20. The method of claim 15 further comprising the step of automatically maintaining the temperature of air in said drying chamber at a predetermined level.

21. A dehydrator comprising an enclosure having walls defining a substantially closed drying chamber therein, door means movably mounted on a front side of said enclosure for normally closing said chamber and openable for exposing said chamber for depositing foodstuffs therein, separate tubular manifold means disposed entirely in and at a rearward end of said chamber and having walls, separate from the walls defining said enclosure, defining an air inlet passage therein, means formed through the walls of said manifold means for communicating air from said inlet passage to said chamber, fan means for pumping ambient air to said inlet passage, heating means for heating the ambient air pumped to said inlet passage to a predetermined temperature level, and means defining an opening on a front side of said enclosure for permitting heated air in said chamber to discharge therefrom at a controlled flow rate while simultaneously maintaining a predetermined back pressure on such air comprising stop means disposed on a forward end of said enclosure and normally engaging said door means to define said opening therebetween.

22. A dehydrator comprising an enclosure having horizontally disposed top and bottom walls and vertically disposed back and side walls defining a drying chamber therein and an open front side thereon, door means movably mounted on the front side of said enclosure for normally closing said chamber and openable for depositing foodstuffs therein, means defining an opening on the front side of said enclosure, adjacent to said door means, for permitting heated air in said chamber to discharge therefrom at a controlled rate, vertically disposed manifold means extending between said top and bottom walls and disposed intermediate said side walls, adjacent to said back wall, defining a plurality of vertically spaced orifices therethrough communicating with the drying chamber defined in said enclosure, fan means mounted on said back wall and communicating with said manifold means for pumping ambient air therethrough, and heating means disposed between said fan means and said manifold means for heating the ambient air pumped from said fan means to said manifold means whereby said heated air passing through said manifold means flows through said chamber and egresses through the opening defined on the front side of said enclosure.

* * * * *